United States Patent [19]

Kanamori et al.

[11] Patent Number: 4,900,586

[45] Date of Patent: Feb. 13, 1990

[54] ELECTRODE APPLICATION TOOL

[75] Inventors: Isamu Kanamori, Takefu; Kiyota Nakai, Fukui; Masami Yamaguchi, Takefu, all of Japan

[73] Assignee: Murata Manufacturing Co., Ltd., Japan

[21] Appl. No.: 202,481

[22] Filed: Jun. 3, 1988

[30] Foreign Application Priority Data

Jun. 4, 1987 [JP] Japan ..... 62-87105

[51] Int. Cl.[4] ..... B05D 5/12

[52] U.S. Cl. ..... 427/125; 427/58; 427/96; 427/430.1; 118/428; 118/500; 118/503

[58] Field of Search ..... 427/125, 58, 430.1, 427/96; 118/428, 500, 503

[56] References Cited

U.S. PATENT DOCUMENTS

| | | | |
|---|---|---|---|
| 2,488,535 | 11/1949 | Hamburg | 118/500 |
| 2,515,489 | 7/1950 | Borushko | 427/430.1 |
| 3,589,938 | 6/1971 | Blewett | 427/58 |
| 3,949,891 | 4/1976 | Butler | 118/500 |
| 4,310,566 | 1/1982 | McGrath | 427/125 |
| 4,671,206 | 6/1987 | Hoppestad | 118/428 |

FOREIGN PATENT DOCUMENTS

| | | | |
|---|---|---|---|
| 2062691 | 5/1981 | United Kingdom | 427/96 |

*Primary Examiner*—Shrive Beck
*Assistant Examiner*—Vi Duong Dang
*Attorney, Agent, or Firm*—Ostrolenk, Faber, Gerb & Soffen

[57] ABSTRACT

An electrode application tool is disclosed for applying of electrode paste to end surfaces of electronic components or collective bodies of electronic components simultaneously at one time. the electrode application tool is designed to have many longitudinal grooves formed in the opposite lateral side surfaces of a main body frame of the application tool so as to accommodate end portions of electronic components or collective bodies of electronic components, and two pairs of upper and lower plate-like elastic members provided so as to cover the upper part and the lower part of the longitudinal grooves, respectively, at least one of each pair allows the longitudinal grooves to be opened, thereby improving productivity of electronic components.

6 Claims, 6 Drawing Sheets

ELECTRODE APPLICATION TOOL

BACKGROUND OF THE INVENTION

The present invention relates to an application tool for use in application of electrode paste to end surfaces of chips of electronic components or to a rectangular plate-like collective of electronic components.

In general, a chip of an electronic component such as a resistor or the like is obtained by a process in which a rectangular plate-like collective body of electronic components is applied at its opposite end surfaces with an electrode paste, and is then broken at given positions into chips. For applying the electrode paste to the end surfaces of the chips in the above-described process for manufacturing an electronic component, such a tool as shown in FIG. 10 has been conventionally used. In FIG. 10, an application tool 11 for applying electrodes to end surfaces of an electronic component is comprised of rotary rollers 12 and 13 provided parallel to each other, paste reservoirs 14 and 15 for storing electrode paste provided under the respective rotary rollers 12 and 13, and doctors 16 and 17 slightly separated from the respective rollers 12 and 13 over the paste reservoirs 14 and 15 of the rollers at the sides remote from the central area where the rollers 12 and 13 confront each other.

When the rotary rollers 12 and 13 are driven by a driving means (not shown in the drawing) such as a motor in directions shown by arrows a and b, respectively, the electrode paste in the reservoirs 14 and 15 is adhered onto the surfaces of the rollers 12 and 13, and the film thicknesses of the adhered electrode paste is controlled to be uniform by the doctors 16 and 17. A collective body 18 of electronic components having a rectangular plate-like shape is carried in between the two rollers 12 and 13. Then, by bringing the rollers 12 and 13 near the collective body 18 are brought into by the contact with the opposite end surfaces of the collective body 18. Thus, the electrode pastes are applied onto the opposite end surfaces of the collective body 18 because of the existence of the above-described contact between the rollers 12 and 13, and the collective body 18.

However, the above-described conventional application tool can not handle many collective bodies of electronic components at one time since the conventional tool requires the collective bodies to be applied with electrode paste one at a time. Moreover, the condition of the contact between the rotary rollers and the collective body presents many unfavorable problems to the process such as determining of electrodes to be applied and the position where the electrode number paste is to be applied.

Although the foregoing description is related to the case where the electrode paste is applied to a collective body of the electronic components, this process can be used to apply electrode paste to individual electronic components after a collective body of electronic components.

SUMMARY OF THE INVENTION

Accordingly, an essential objective of the present invention is to provide an application tool which is arranged to uniformly apply electrode paste onto opposite end surfaces of an electronic component or a collective body of electronic components, in order to productivity.

In order to accomplish the above-described objective, according to the present invention, the application tool comprise many longitudinal grooves formed in the opposite lateral side surfaces of the application tool's main body frame in order to accommodate end portions of electronic components or collective bodies of electronic components, and two pairs of upper and lower plate-like elastic members provided so as to cover the upper part and the lower part of the longitudinal grooves, respectively, where at least one pair of the elastic members allows the longitudinal grooves to be opened.

According to the above-described construction of the application tool, many longitudinal grooves are placed in the opposite lateral side surfaces of the main body frame to hold the position of the electronic components or the collective body of electronic components and prevent it from moving horizontally within the main frame. At the same time, the plate-like elastic members covering the upper and lower parts of the grooves can hold the position of the electronic components or the collective bodies of electronic components from moving vertically. Therefore, the electronic components or the collective bodies of electronic components will be placed in the main body from such that their end surfaces to the front and rear surfaces of the frame main body frame. Accordingly, even when the main body frame accommodates many electronic components or many collective bodies of electronic components and is turned upside down, there is no possibility that the electronic components or the collective body of electronic components will slip from the main body frame. On the contrary, while the electronic components or the collective bodies of electronic components are kept within the main body frame, they can be applied with electrodes at one time simply by pressing the application tool against a surface plate which contains electrode paste. Since the interval between the longitudinal grooves and the position of the grooves is fixed for each electronic component or each collective body of electronic components, the components can be automatically sent in and out of the longitudinal grooves if the interval and position of the longitudinal grooves are adjusted in advance for the electronic components. Further, the plate-like elastic members will compensate for differences of size and for any burrs of the collective bodies of electronic components, which allows electrodes to be uniformly applied onto their end surfaces.

In addition, another object of the present invention is to provide a method for placing electrode paste onto an end surface of an electronic component or a collective body of electronic components using the application which, comprising the steps of accommodating the electronic component or the collective body between the central pairs of longitudinal grooves of the main body by shifting the pairs of elastic members to the one side to open the longitudinal grooves, returning the pairs of elastic members back to the original position to close the longitudinal grooves so that the electronic component or the collective body is retained within the longitudinal grooves of the main body and the pairs of elastic members, pressing a first end plane of the electronic component or the collective body onto a surface plate which contains electrode paste to be applied to the one end plane, separating the electronic component or the collective body from the surface plate, pressing a second end plane opposite to the first end plane onto the surface plate to be applied with electrode paste provided on the surface plate, and separating the electronic component or the collective body from the surface plate.

BRIEF DESCRIPTION OF THE DRAWINGS

These and other objects and features of the present invention will become clear from the following description of preferred embodiments thereof, with reference to the accompanying drawings, in which.

DETAILED DESCRIPTION OF THE INVENTION

Figure 1:
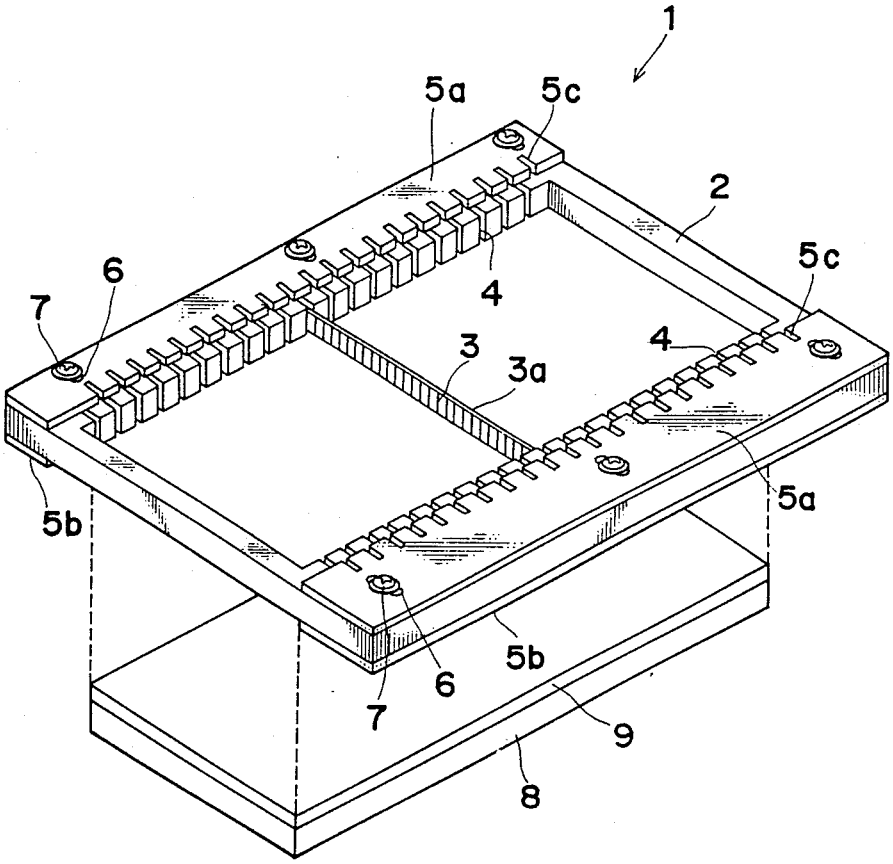
FIG. 1 is a perspective view of an electrode application tool according to one preferred embodiment of the present invention.

Before the description of the present invention proceeds, it is to be noted that like parts are designated by like reference numerals throughout the accompanying drawings.

Referring to FIG. 1, a perspective view of an electrode paste application tool for electronic components according to one preferred embodiment of the present invention is shown. In FIG. 1, an application tool 1 consists of a main body 2 in a rectangular frame shape. Many longitudinal grooves 4 are placed in the lateral side surfaces of the main body 2 into which opposite end portions of a collective body 3 of electronic components are inserted. Leaf springs 5*a* and 5*b* are placed above and under the longitudinal grooves 4.

Figure 4:
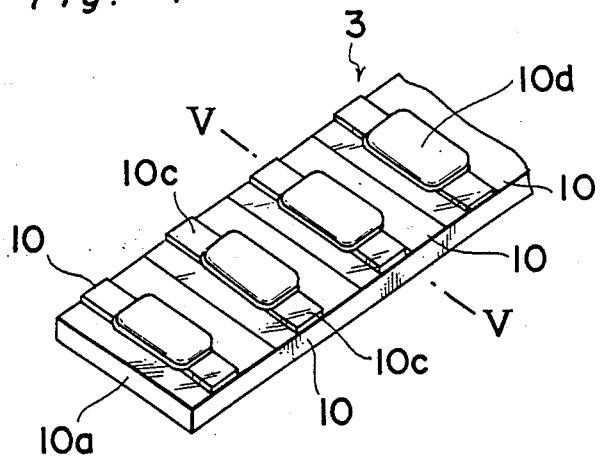
FIG. 4 is a perspective view of the collective body before applying electrode paste thereon.
Figure 5:
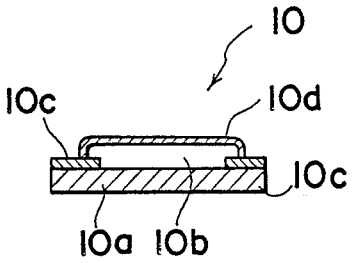
FIG. 5 is a cross-sectional view of the collective body taken along a line V—V of FIG. 4.
Figure 6:
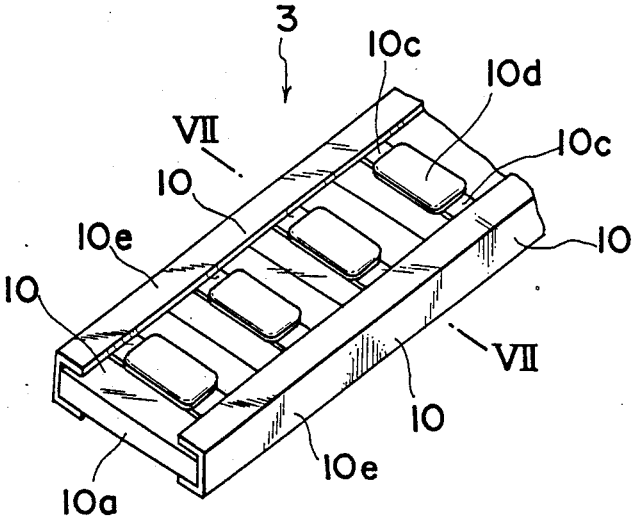
FIG. 6 is a view similar to FIG. 4, in which electrode paste has been applied both sides of the collective body.
Figure 7:
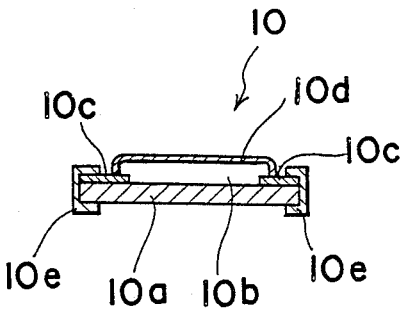
FIG. 7 is a cross-sectional view of the collective body taken along line VII—VII of FIG. 6.

Each of electronic components 10 of the collective body 3 is constructed of a base plate 10*a* made of aluminum and the like, resistance materials 10*b* provided on the base plate 10*a*, a pair of inner electrodes 10*c* provided at the both ends of the resistance materials 10*b* on the base plate 10*a*, and a protective glaze 10*d* coated on the resistance materials 10*b*, as shown in FIGS. 4 and 5. The electrode paste application tool 1 is employed to apply electrode paste 9 onto the ends of the electronic components 10 in order to form outer electrodes 10*e* to be connected with the inner electrodes 10*c*, as shown in FIGS. 6 and 7.

The aforementioned main body 2 is made of a material having relatively high rigidity, for example, aluminum. The thickness of the frame main body 2 is set to be equal to or slightly larger than the height of the collective body 3. Moreover, the longitudinal groove 4 has a width equal to or a little larger than the thickness of the collective body 3 of electronic components. Each of the leaf springs 5*a* and 5*b* is formed with notches 5*c* facing each other to enhance the elasticity of the leaf springs 5*a* and 5*b*. The notches 5*c* are arranged in positions so that they will not overlap with the longitudinal grooves 4 of the main body 2. The leaf springs 5*a* and 5*b* are secured to the main body 2 by pins 7 through elongated holes 6 formed at the side of the leaf springs 5*a* and 5*b* where the notches 5*c* are not formed. The pins 7 may be moved within the elongated holes to open the longitudinal grooves 4.

Figure 2:
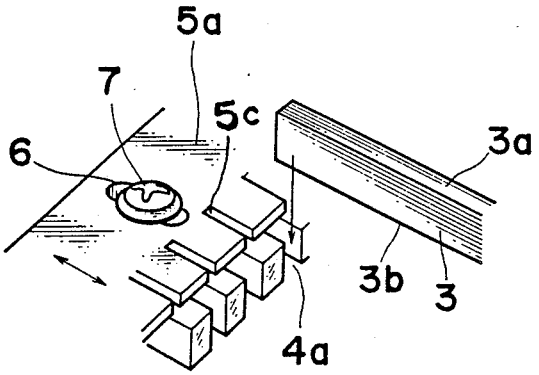
FIG. 2 is an enlarged view of part of the application tool of FIG. 1.

FIG. 2 illustrates how the collective body 3 of electronic components is accommodated in the application tool 1.

Each of the upper leaf springs 5*a* and 5*a* is slid towards the outer periphery of the main body 2, so that the longitudinal grooves 4 are all open. The opposite end portions of each of the collective bodies 3 of electronic components are inserted into the longitudinal grooves 4 one by one. After the collective bodies 3 are inserted into all of the grooves 4, the upper leaf springs 5*a* and 5*a* are returned to the original position, completing the accommodation of the collective bodies. At this time, the opposite end portions of each collective body 3 are held by the longitudinal grooves 4 in a horizontal direction, and moreover, are restricted in a vertical direction by the elastic depression of the leaf springs 5*a* and 5*b* which cover the upper and lower parts of the longitudinal grooves 4. Thus, many collective bodies 3 are held in the longitudinal grooves 4, with the front and rear end surfaces 3*a* and 3*b* being exposed.

The electrode paste or paint, used with the application tool, contains silver to form an electrode for connection or conduction and it will be applied in the following manner.

A surface plate 8 of FIG. 1, has a convex upper surface corresponding to the inner periphery of the frame main body 2, and is applied with electrode paste 9 at the convex portion. Then, the one end surface 3*a* exposed from the application tool 1, is pressed onto the surface plate containing electrode paste whereby electrode paste is applied simultaneously at one time to the collective bodies. Next, the application tool 1 is reversed, and the second end surfaces 3*b* of the collective bodies 3 are pressed against the surface plate to be adhered to with electrode paste. Thereafter, while the many collective bodies 3 are retained in the application tool 1, the electrode paste applied onto the opposite ends surfaces 3*a* and 3*b* of the collective bodies 3 is dried. After drying of the electrode paste, in the similar manner as above, the upper leaf springs 5*a* and 5*a* are slid to open the longitudinal grooves 4, thus removing the restriction on the collective bodies so that the collective bodies can be removed.

In the application tool of the above-described construction, two pairs of leaf springs work to restrict the collective bodies of electronic components from moving up and down, namely, in the vertical direction. This prevents the collective bodies from slipping off the application tool. At the same time, the leaf springs are formed with notches to make pieces which correspond individually to each collective body of electronic components, to absorb not only the size differences and burrs of the collective bodies, but also to compensate for warpage of the surface plate or the main body frame of the application tool. Therefore, according to the present invention, electrode paste can be applied uniformly and simultaneously at one time onto the end surfaces of many collective bodies of electronic components. In addition, the longitudinal grooves are directly formed in the frame main body. The interval of the longitudinal grooves and the size of the frame main body can be determined for each collective body of electronic components, so that the insertion and removal of the electronic components or the collective bodies can be performed automatically. This process not only works for collective bodies of electronic components, but also for individual electronic components, by breaking the collective body of electronic components one by one, into components having a narrower width than the collective body. It is needless to say that one electronic component may have the same size as the collective body of electronic components in the present embodiment, or it may be larger than the collective body of the present embodiment.

Figure 3:
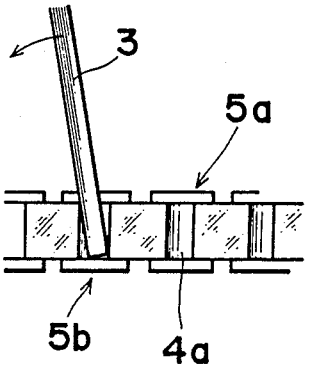
FIG. 3 is a view explaining how a collective body of electronic components is broken by the use of the application tool of FIG. 1.

When the collective body of electronic components applied with electrode paste at opposite end surfaces thereof is to be broken into chips of an electronic component, the collective body is inserted into the longitudinal grooves 4, as shown in FIG. 3, with the end surfaces 3*a* and 3*b* thereof turned in a longitudinal direction, and then the right side or the left side of the collective body is given pressure, to break the collective body without any particular guide plate or the like, by the utilization of the angles defined by the longitudinal groove 4 and the main body frame.

It is to be noted that leaf springs are employed in the present embodiment for the plate-like elastic member, but it is not restricted to the leaf springs, and may use any material so long as it is in a plate-shape, has elasticity, and notches can be formed therein. Further, the plate-like elastic members need not be moveable on the application tool as described above. Instead, they may be detachable from the application tool, by way of example. Moreover, it is enough that at least one of the upper and lower plate-like elastic members can render the longitudinal grooves in an opened condition.

As is clear from the foregoing description, according to the present invention, the electronic components or the collectives of electronic components are restricted in position in the horizontal direction by the longitudinal grooves formed in the frame main body, and also, restricted in position in the vertical direction by two pairs of upper and lower leaf springs placed above and under the longitudinal grooves, so that the many of the exposed electronic components can be simultaneously applied with electrode paste at their end surfaces, without slipping off from the application tool. The number of the electronic components or the collective bodies of electronic components corresponds to the number of longitudinal grooves, and therefore, allows many electronic components to be processed at one time. Since the interval and position of the longitudinal grooves are determined for each collective body of electronic components, the insertion and removal of the electronic components can be conducted automatically, resulting in remarkable improvement of productivity. Moreover, the leaf springs are placed in a manner to cover the upper and lower parts of the longitudinal grooves to absorb differences in size or burrs of the collective bodies of electronic components, and warpage of the surface plate for applying electrode paste to electronic components, to ensure that the electronic paste is uniformly applied onto the end surfaces of the collective bodies to form electrodes. In addition, the application tool of the present invention has a further advantage in that the collective bodies of electronic components can be broken into separate electronic components, without requiring any special means thereof.

Figure 8:
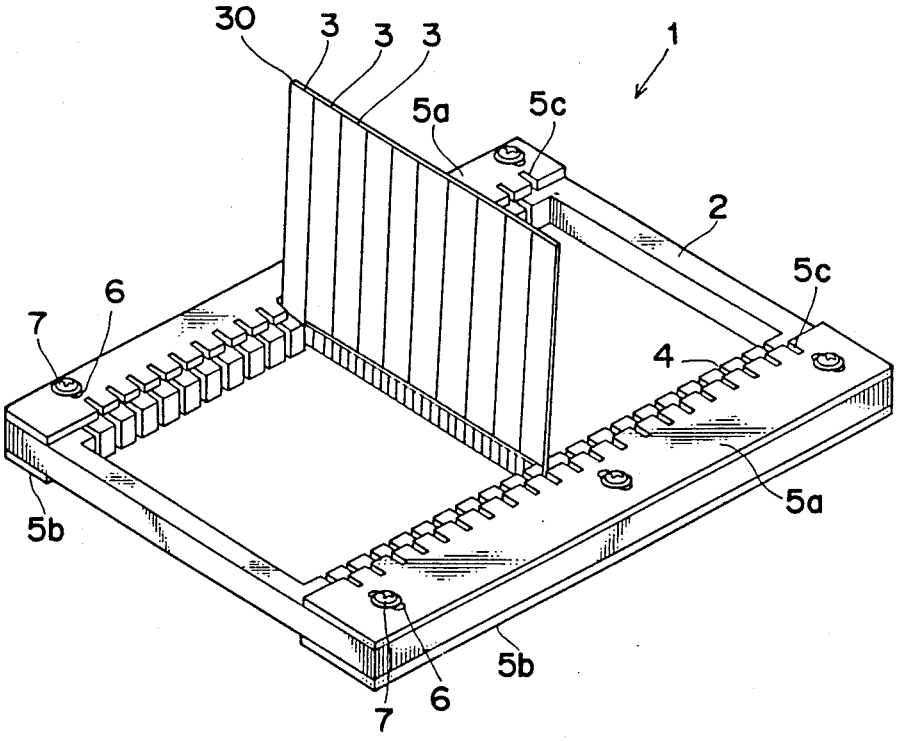
FIG. 8 is a view similar to FIG. 1, but in which a breakable unit is set in the electrode application tool.
Figure 9:
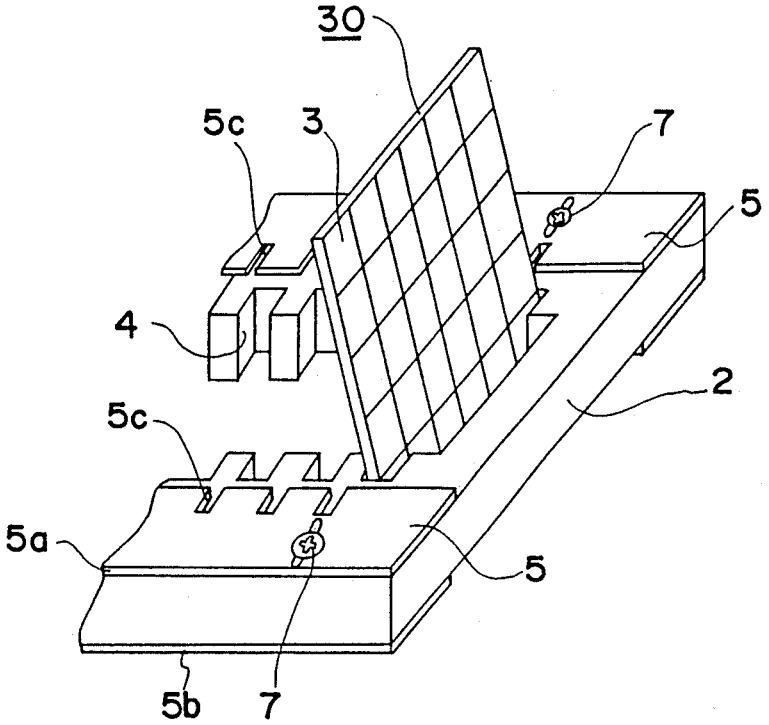
FIG. 9 is a perspective view, on an enlarged scale, showing the breakable unit set in the electrode application tool of FIG. 1.
Figure 10:
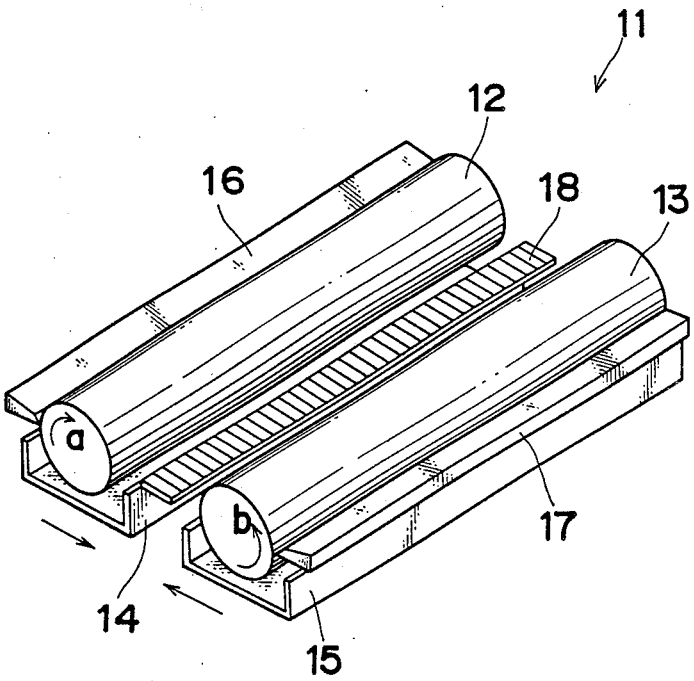
Fig. 10 PRIOR ART
FIG. 10 is a perspective view of a conventional electrode application tool (already referred to).

Although the present invention has been fully described in connection with the preferred embodiments thereof with reference to the accompanying drawings, it is to be noted that various changes and modifications are apparent to those skilled in the art. For instance, the application tool of the present invention can also be used to apply electrode paste onto the both sides of a breakable unit 30 consisting of a plurality of the collective bodies 3, to be divided into the individual collective bodies, as shown in FIGS. 8 and 9. Such changes and modifications are to be understood as included within the scope of the present invention as defined by the appended claims unless they depart therefrom.

What is claimed is:

1. An application tool for applying electrode paste onto an end surface of an electronic component or a collective body of electronic components comprising:

a main body in a frame shape;

longitudinal grooves placed in lateral side surfaces of said main body which face each other across a central aperture of said main body, to retain end portions of the electronic component or the collective body of electronic components disposed in said central aperture; and two pairs of plate-like elastic members provided on said main body so as to cover the upper and lower parts of said longitudinal grooves, respectively, at least one pair of said upper and lower pairs of plate-like elastic members being movable on said main body so as to allow access to said longitudinal grooves.

2. The application tool as defined in claim 1 wherein each of the elastic members comprises a leaf spring.

3. The application tool as defined in claim 1, wherein each of said elastic members contains notches facing said central aperture which are out of alignment with said longitudinal grooves of said main body frame.

4. A method for applying an electrode on an end surface of an electronic component or a collective body of electronic components comprising the steps of:

accommodating the electronic component or the collective body between the confronting pairs of longitudinal grooves formed on side surfaces facing each other across a central aperture of a frame-like main body, by shifting a pair of movable elastic members mounted on said main body which close said grooves when in a closed position, to open the longitudinal grooves so that said electronic component or collective body may be inserted, returning the pairs of elastic members back to the original closed position to close the longitudinal grooves so that the electronic component or the collective body is held within the longitudinal grooves surrounded by the main body and the pairs of elastic members, pressing a first end plane of the electronic component or the collective body onto a surface plate on which electrode paste is provided to apply said paste to said first end plane, and separating the electronic component or the collective body from the surface plate.

5. The method of applying an electrode according to claim 4, further comprising the steps of pressing a second end plane opposite to the first end plane of the electronic component or the collective body onto the surface plate to apply the electrode paste provided on the surface plate thereto, and separating the electronic component or the collective body from the surface plate.

6. The method of applying an electrode according to claim 5, further comprising the steps of drying said first and second end planes of the electronic component or the collective body, and opening said grooves to remove the electronic component or the collective body.

* * * * *